US007191707B1

(12) United States Patent
Davis

(10) Patent No.: US 7,191,707 B1
(45) Date of Patent: Mar. 20, 2007

(54) SPHERICAL ROLLING EXPLOSIVE ORDINANCE

(76) Inventor: Russell J. Davis, 9747 Water Oak Dr., Fairfax, VA (US) 22031-1029

( * ) Notice: Subject to any disclaimer, the term of this patent is extended or adjusted under 35 U.S.C. 154(b) by 9 days.

(21) Appl. No.: 11/272,786

(22) Filed: Nov. 15, 2005

(51) Int. Cl.
*F42B 27/00* (2006.01)
*F42C 15/26* (2006.01)

(52) U.S. Cl. ..... 102/488; 102/482; 102/237

(58) Field of Classification Search ..... 102/482, 102/487, 488, 396, 397, 237, 425
See application file for complete search history.

(56) References Cited

U.S. PATENT DOCUMENTS

| | | | | | |
|---|---|---|---|---|---|
| 2,327,621 | A | | 8/1943 | Conrad | |
| 2,340,299 | A | | 2/1944 | Bjorkman | |
| 3,045,596 | A | | 7/1962 | Rae | |
| 3,112,703 | A | * | 12/1963 | Urdapilleta | 102/487 |
| 3,570,404 | A | * | 3/1971 | Pope | 102/207 |
| 3,603,258 | A | | 9/1971 | Green | |
| 3,667,387 | A | | 6/1972 | Picard et al. | |
| 3,838,642 | A | | 10/1974 | Shimberg | |
| 3,850,102 | A | * | 11/1974 | Morrow | 102/210 |
| 3,981,239 | A | * | 9/1976 | Czajkowski et al. | 102/393 |
| 4,285,403 | A | | 8/1981 | Poland | |
| 4,406,210 | A | | 9/1983 | Baker et al. | |
| 4,407,201 | A | * | 10/1983 | Jensen | 102/248 |
| 4,676,166 | A | | 6/1987 | Spies et al. | |
| 4,703,693 | A | * | 11/1987 | Spies et al. | 102/215 |
| 4,773,330 | A | * | 9/1988 | Losfeld | 102/487 |
| 5,375,528 | A | | 12/1994 | Brinkman et al. | |
| 5,635,667 | A | * | 6/1997 | Boyer et al. | 102/487 |
| 6,231,002 | B1 | | 5/2001 | Hibma et al. | |
| 6,231,003 | B1 | | 5/2001 | Hibma et al. | |
| 6,272,995 | B1 | * | 8/2001 | Schmidt et al. | 102/209 |
| 6,666,145 | B1 | * | 12/2003 | Nardone et al. | 102/489 |
| 2003/0006046 | A1 | | 1/2003 | Kaimart | |

FOREIGN PATENT DOCUMENTS

| | | |
|---|---|---|
| DE | 3345362 | 6/1985 |
| DE | 3345363 | 6/1985 |
| DE | 3738437 | 6/1989 |

* cited by examiner

*Primary Examiner*—Michael J. Carone
*Assistant Examiner*—Bret Hayes
(74) *Attorney, Agent, or Firm*—Richard C. Litman

(57) ABSTRACT

The spherical rolling explosive ordnance is a bomb having a substantially spherical shaped structure that includes a hard outer shell and a shock absorbing outer layer. The spherical shaped structure has a hollow inner core that is symmetrically disposed about an axial center of the structure. Within the hollow inner core are a plurality of mutually orthogonal motion sensors and a computing device. The sensors are electrically coupled to the computing device which accepts sensor outputs to process a plurality of motion profile samples. An explosive charge is distributed between the shell and the core. A fuse mechanism within the explosive charge is electrically coupled to a primary arming device. The primary arming device is armed responsive to the predetermined criteria of the motion profile samples. Arming the arming device causes the fuse to be ignited to provide detonation of the ordnance device.

20 Claims, 7 Drawing Sheets

SPHERICAL ROLLING EXPLOSIVE ORDINANCE

BACKGROUND OF THE INVENTION

1. Field of the Invention

The present invention relates to ordnance devices, and particularly to a rolling ordnance device that autonomously estimates its position relative to a reference coordinate system.

2. Description of the Related Art

It would be highly desirable for field combat operations to have a rolling bomb that can operate in a constrained space, and yet be non-injurious to friendly personnel. Ideally, this bomb could be tossed in the air, rolled or slid on the ground, tossed, air dropped or rolled into caves, bunkers, and the like, with the assurance that it would not detonate until a specific motion criterion has been met. Additionally, the bomb should be simple, easy to operate, and not actively propelled by rockets, jets, and the like. That is to say, the bomb should be more like a grenade with awareness of its own motion, than like a guided missile with target seeking capability. Such a bomb would be ideally suited for missions where there may not be a target signature to acquire, but there may be physical obstacles between combat personnel and a high value target having a high probability locus, such as, for example a target located deep within a cave having multiple layers above the target. Multiple bomb spherical rolling ordnance, such as the present invention, could be rolled into the cave, each bomb taking out successive layers of protection above the intended target, until the final one reaches the target.

German patent DE 3,345,362 published June, 1985, discloses a mine having an explosive charge and also having rotational and translational acceleration devices, i.e., jet engines, to establish spinning and rolling motion. The spinning is provided to acquire a target signature, and the rolling is provided to roll the mine towards the target after target acquisition. Such a device however would be ill suited for the aforementioned cave scenario, because the target does not necessarily reveal a signature, and intermediate levels between personnel and the target must be taken out first.

Similarly, German patent DE 3,345,363 published June, 1985, discloses a spherical mine with logic controlled internal jet engines for propulsion and a proximity sensor for explosion on contact with a tank. Clearly, for the same reasons as mentioned above, the disclosure in patent DE 3,345,363, unlike the present invention, does not adequately address the cave target scenario.

Additionally, German patent DE 3,738,437 published June, 1989, discloses a spherical rolling mine that is cylindrical before deployment and is converted to the spherical shape after being launched or fired. The present invention, unlike the reference, does not require a shape transformation to the spherical form before deployment.

None of the above inventions and patents, taken either singly or in combination, is seen to describe the instant invention as claimed. Thus, a spherical rolling explosive ordinance solving the aforementioned problems is desired.

SUMMARY OF THE INVENTION

The spherical rolling explosive ordinance is a bomb having a substantially spherical shaped structure that includes a hard outer shell and a shock absorbing outer layer.

The spherical shaped structure has a hollow inner core that is symmetrically disposed about an axial center of the structure.

Within the hollow inner core are a plurality of mutually orthogonal motion sensors and a computing device. The sensors are electrically coupled to the computing device which accepts sensor outputs to compute a successive plurality of ordnance device motion profiles.

An explosive charge is distributed between the shell and the core. A fuse mechanism within the explosive charge is electrically coupled to a primary arming device. The primary arming device is armed responsive to a predetermined criterion of the successive plurality of ordnance device motion profiles. Arming the arming device causes the fuse to be ignited to provide detonation of the ordnance device.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
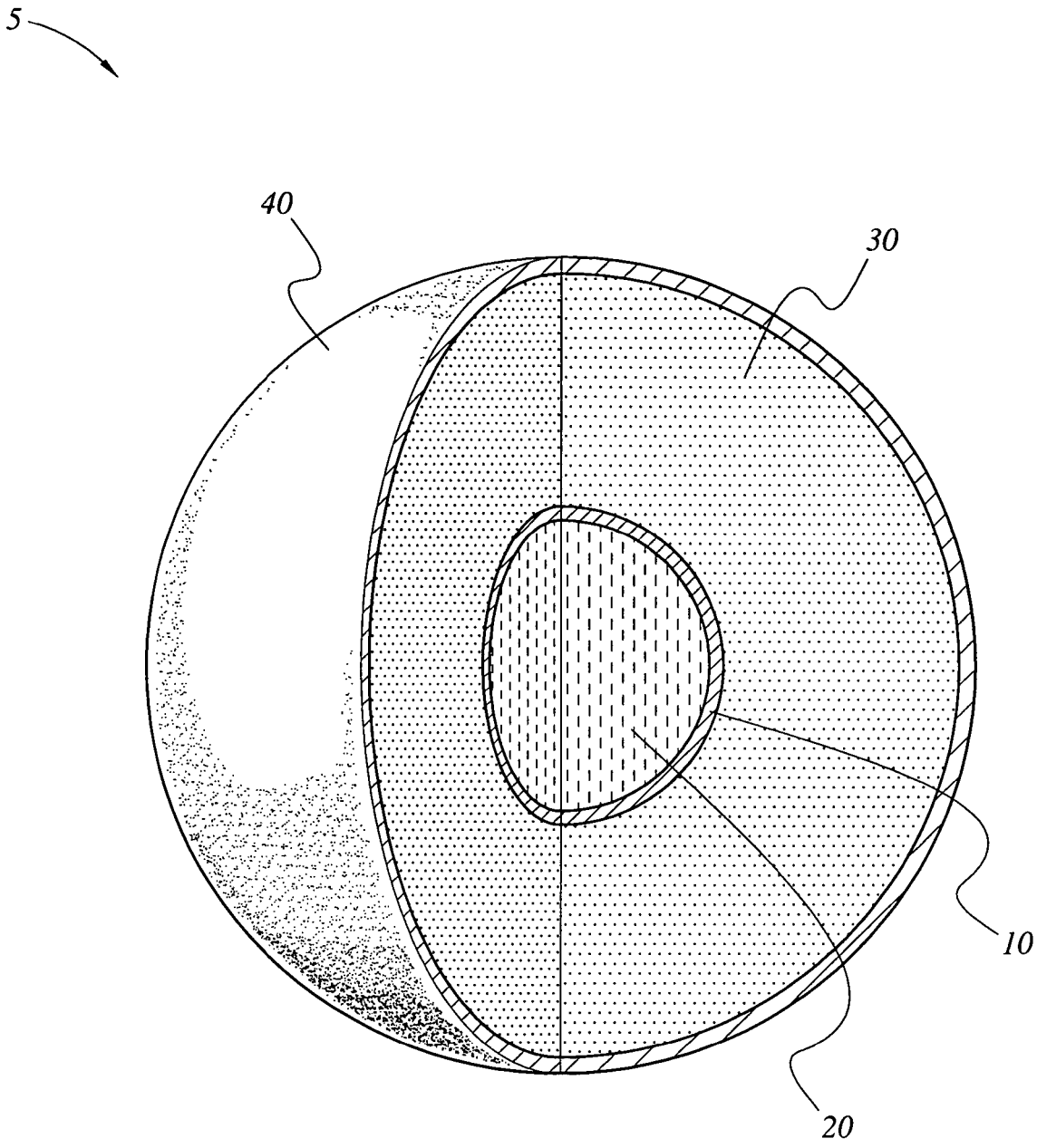
FIG. 1 is a cut away view of the rolling explosive ordnance construction according to the present invention.

As shown in FIG. 1, the present invention is a bomb 5 having a substantially spherical shaped structure that includes a hard outer shell 40, the combination being adaptable to rolling on a variety of surfaces, including but not limited to roads, rugged terrain, stairs, and the like. Additionally, the outer shell 40 may be selected or coated to provide a surface having a customized coefficient of friction tailored to a mission type in which the bomb 5 is expected to be deployed. The spherical shaped structure has a hollow inner core 20 that is symmetrically disposed about an axial center of the structure. A periphery of the hollow inner core 20 comprises a shock absorbing outer layer 10 to provide shock protection to internal electronic components within the core 20.

Figure 4:
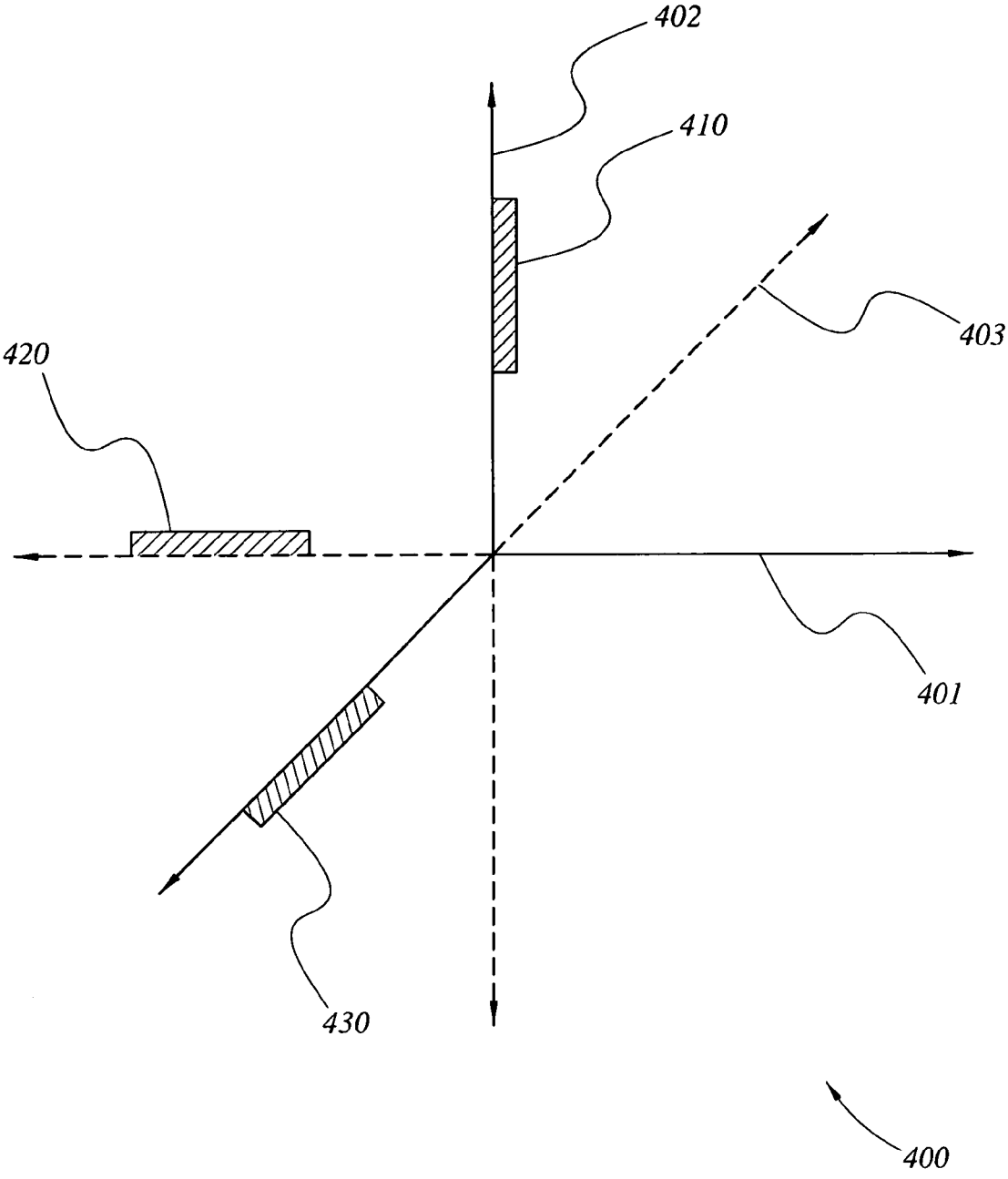
FIG. 4 is a body frame of reference and motion sensor alignment, according to the present invention.
Figure 7:
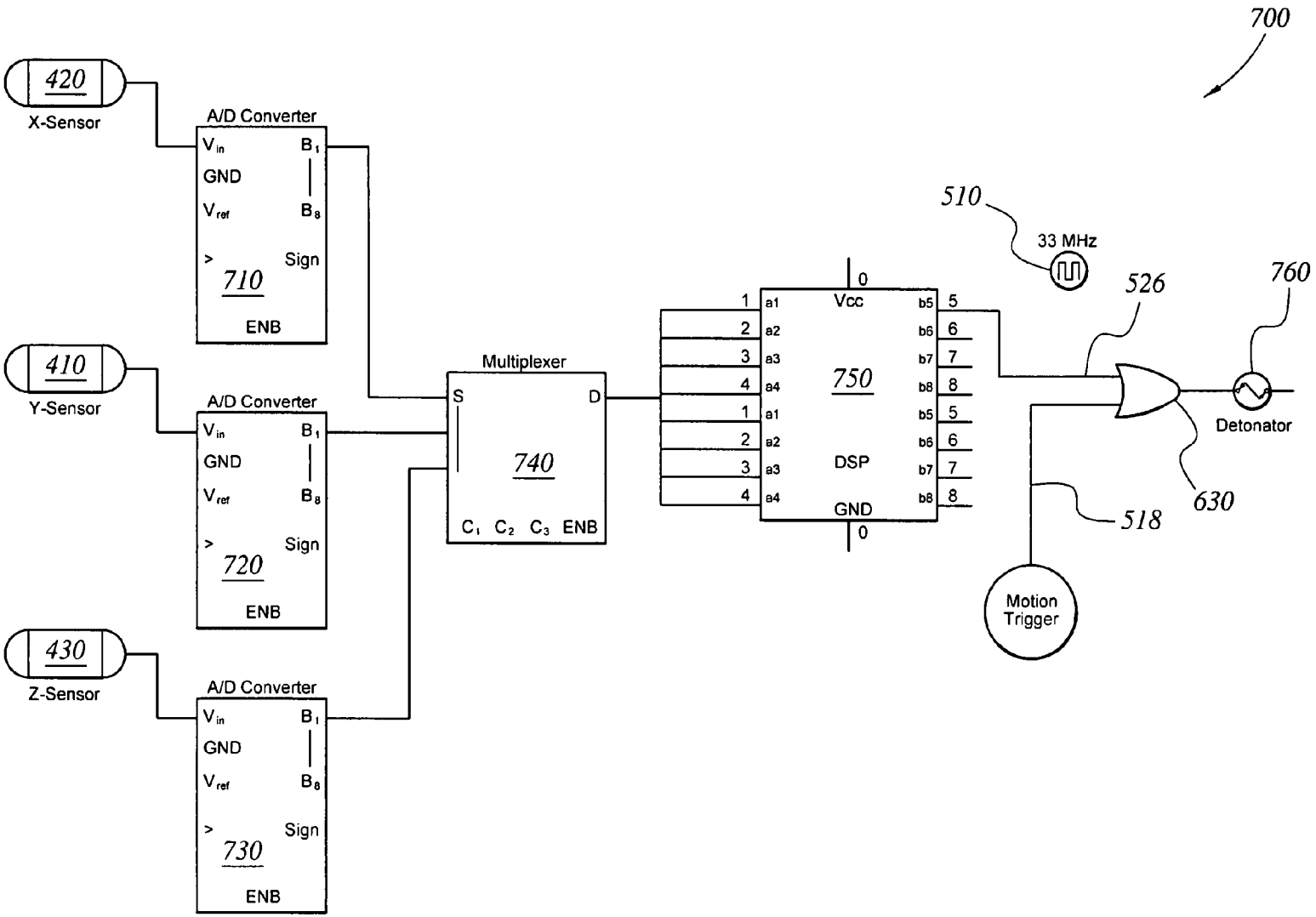
FIG. 7 is a schematic diagram of a motion calculated trigger, according to the present invention.

Rigidly attached within the hollow inner core 20, and as diagrammatically shown in FIGS. 4 and 7, are a plurality of mutually orthogonal motion sensors, such as x 401 body coordinate sensor 420, y 402 body coordinate sensor 410, and z 403 body coordinate sensor 430, and a computing device, such as Digital Signal Processor (DSP) 750. The sensors 410, 420, 430 are electrically coupled to the computing device 750 which accepts sensor outputs to process a successive plurality of ordnance device motion profiles, i.e., motion profile samples. As shown in FIG. 7, in the event that the sensors 410, 420 and 430 have analog outputs, they may be individually coupled to Analog to Digital (A/D) converters 710, 720, and 730 and then multiplexed by multiplexer 740. Time divided sensor data acquisition is provided by multiplexer 740 which has an output that is read by computing device, DSP 750.

Figure 2:
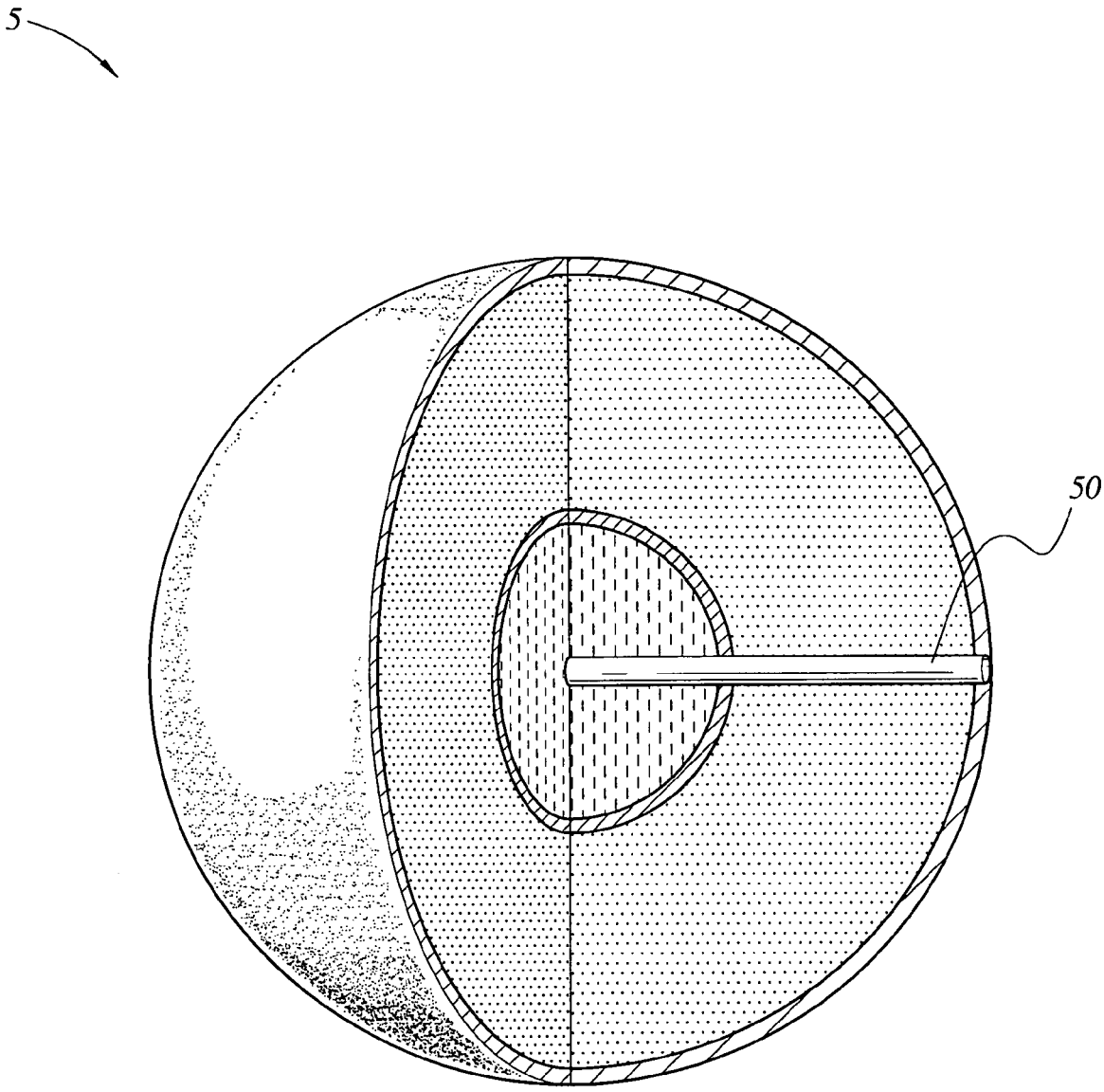
FIG. 2 is a cut away view of the ordnance detailing the fuse and battery insert plug, according to the present invention.
Figure 6:
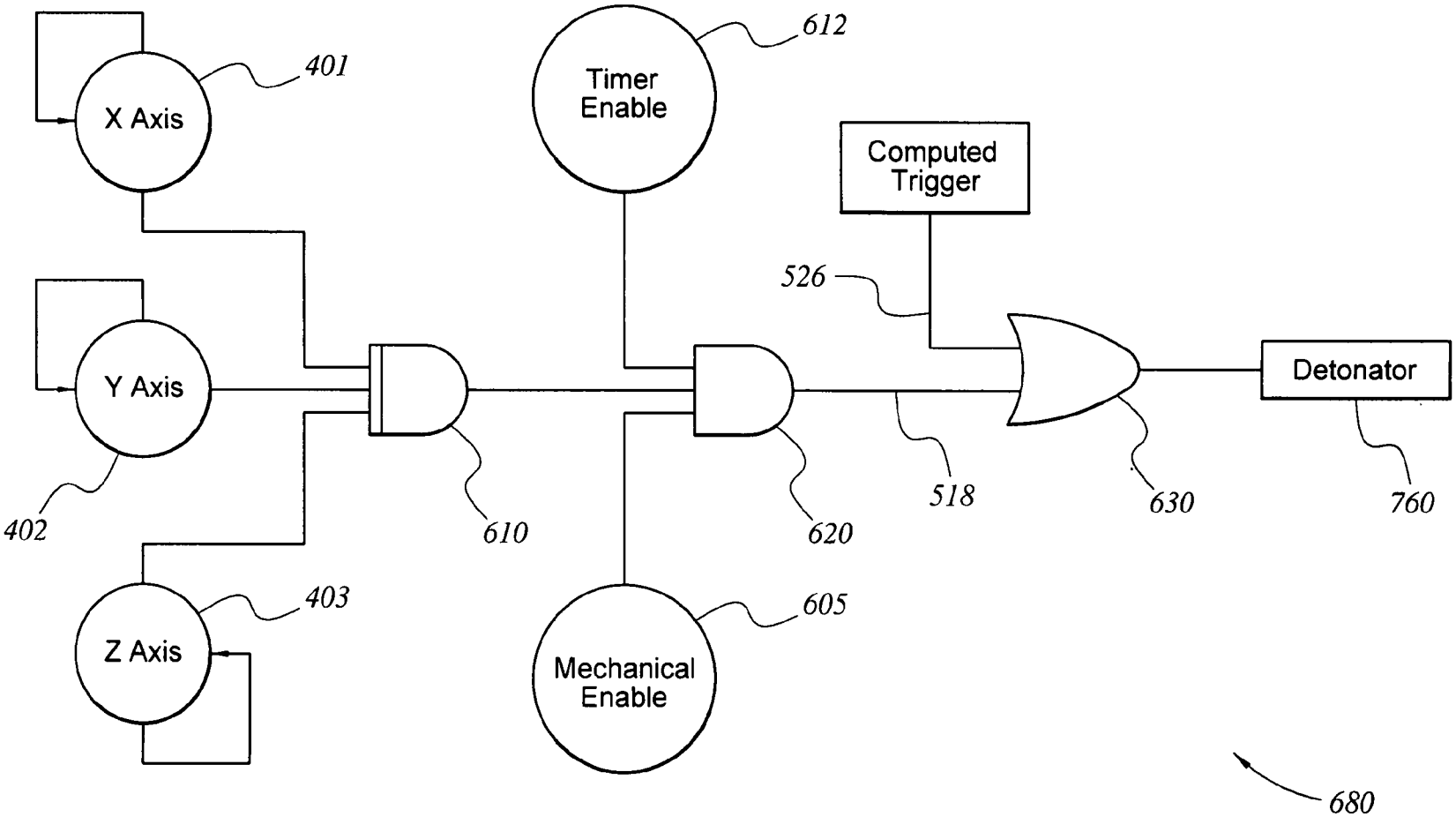
FIG. 6 is a logical interconnect diagram, according to the present invention.

As shown in FIGS. 1, 2 and 6, an explosive charge 30 is distributed between the shell 40 and the core 20. A primary fuse mechanism 50 within the explosive charge 30 is electrically coupled to a primary arming device 630. The primary arming device 630 is armed responsive to predetermined criteria of the motion profile samples. One of the predetermined criteria may function as a computer trigger CT 526. Arming the arming device 630 causes detonator 760 to ignite the primary fuse 50 to provide detonation of the ordnance device 5. Additionally, a secondary fuse and timer may be provided to ensure detonation if the primary fuse 50 should fail.

Figure 3:
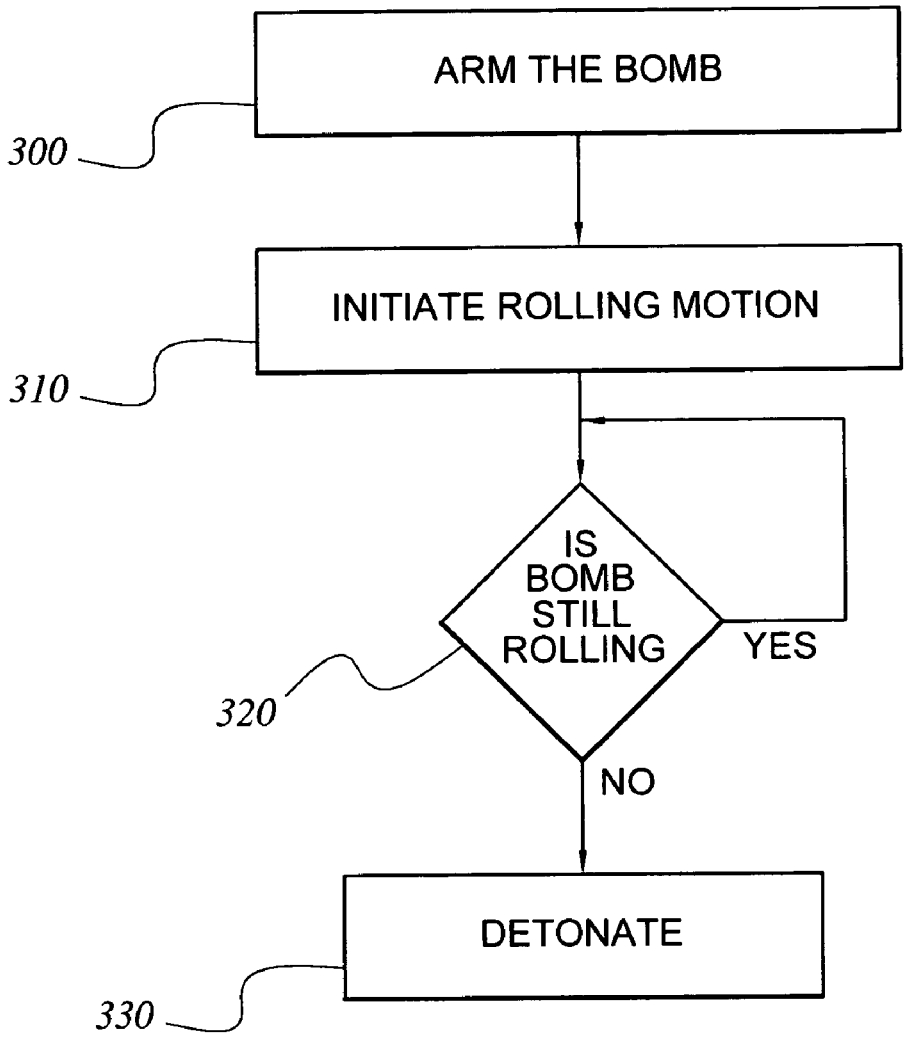
FIG. 3 is an arming and detonation flow chart, according to the present invention.

In the embodiment shown, the arming device 630 is alternatively armed by CT 526, OR a special case motion trigger MT 518 in which the motion profile samples indicate that the ordnance 5 is motionless. As shown in FIG. 3, exemplary special case motion trigger MT 518 is an operatively sequential logic that first arms the bomb 5 at step 300, allows for rolling motion initiation at step 310, checks for bomb rolling motion at step 320 and then, as shown at step 330, detonates the bomb 5 if the rolling motion has stopped.

It is also within the scope of the present invention to provide a motion trigger MT 518 that arms the bomb 5 when translational motion of the bomb 5 has stopped, without regard to whether or not the bomb 5 is rolling. As shown in FIG. 6, before motion trigger MT 518 or computed trigger CT 526 can cause detonation, the ordnance 5 must be mechanically enabled as shown at 605, i.e., the bomb must be released or deployed.

Additionally, it is shown that NAND gate 610 will assert itself only if the motion at x axis 401, and the motion at y axis 402, and the motion at z axis 403 are all zero. The assertion of NAND gate 610 is ANDed at gate 620 with a timer enable trigger, i.e., count down/up timer, and the aforementioned mechanical enable ME 605. The output of AND gate 620 is thus a fail-safed and reliable motion trigger MT 518 that arms the primary arming device only after a predetermined time has elapsed.

Figure 5:
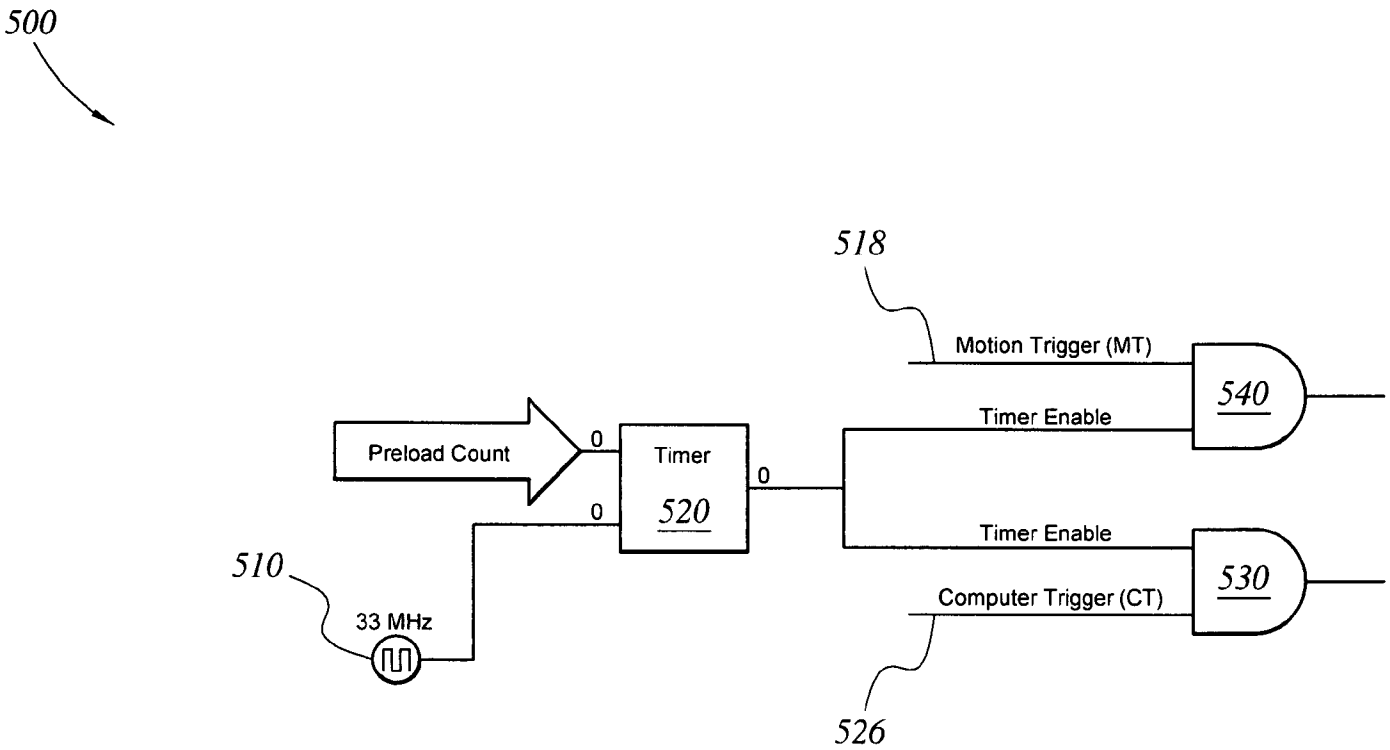
FIG. 5 is a schematic diagram of a timer enable circuit, according to the present invention.

As shown in FIG. 5, an alternative fail-safe mechanism preloads a timer 520 which counts to or from the preload based on an exemplary system clock speed 510 of 33 MHZ to create the timer enable which is ANDed at AND gate 540 with motion trigger MT 518, and ANDed at AND gate 530 with computer trigger CT 526 to arm the arming device 760 only after a predetermined time has elapsed. As one familiar with the art can readily deduce, there exist many fail-safe combinations that can be implemented to prevent premature detonation, according to the present invention. It should also be noted that a second of the predetermined criteria of the motion profile samples may be assigned to a predetermined velocity that sets the motion trigger MT 518 of the ordnance device 5. The preferred minimum system clock speed of 33 MHZ is provided to facilitate rapid acquisition and processing of the motion profile samples.

Due to the massive computing power of today's DSPs, it should be noted that a variety of kinematic equations may be stored in DSP 750, and made available for real-time processing to compute the aforementioned motion profile samples of the ordnance 5 in all states of motion, i.e., whether the ordnance is rolling on the ground, spinning, flying on a trajectory with or without rotation, falling, and the like.

Additionally, a reference coordinate system could be preloaded into the ordnance 5 through an optional input data port accessible from the outer layer 40. Once the ordnance 5 is deployed, the sensors 410, 420, and 430 would provide the DSP 750 with sufficient information to provide a location estimator to dead-reckon the ordnance 5 position as a function of linear, i.e., translational and angular, i.e., rotational accelerations of the ordnance 5 relative to the preloaded reference coordinate system so that bomb 5 can be detonated after a predetermined location within the reference coordinate system has been reached. Alternatively, the reference coordinate system may be defined as always having an origin at a point of deployment of the ordnance 5, thus obviating the necessity of preloading the reference coordinate system through an input data port.

It is within the scope of the present invention to include the necessary algorithmic tools to provide this location estimator. Tools, such as, but not limited to, Euler angle calculation, quaternion calculation, Cartesian coordinate transformation, rotational coordinate transformation, and the like may be implemented in DSP 750 of the present invention to implement the location estimator function.

Moreover, predicting where a sensor is oriented on a rolling body may require the estimation of angular position currently and at the next sample. As the number of samples per unit time increases, the change between samples asymptotically approaches a limit which can be estimated linearly. For the purpose of describing the concept, a linear approximation is presented.

As with any circular rotation, values are capable of cycling between positive and negative numbers. A rotation position predictor may be implemented such that motion profile samples are expressed as:

$$X_n - X_{n-1} = \delta X$$

$$Y_n - Y_{n-1} = \delta Y$$

$$Z_n Z_{n-1} = \delta Z$$

Furthermore, an environment of the ordnance 5 may be represented by factors such as the static and dynamic coefficients of friction, gravity, and incline, i.e., K. The environmental influences, K, may be capable of being measured by the sensors 410, 420, 430, in which case the location estimation could be enhanced based on the sensor measurements of these influences. The motion profile samples could be averaged over several periods, thus presenting a moving average filter to simplify and improve the position estimates.

The next predicted location based on the rolling component is:

$$X_{n+1} = \delta X - X_n + KX$$

$$Y_{n+1} = \delta Y - Y_n + KY$$

$$Z_{n+1} = \delta Z - Z_n + KZ$$

To determine if there is an impact that must be adjusted, $\xi$ may be provided as the threshold impact determination function determined by the mission to require a new rotation orientation. Additionally, the threshold value $\xi$ may have different values depending on the angular rotation of the sphere during the sample calculation.

When $|\delta X + KX| \geqq \xi$, or $|\delta Y + KY| \geqq \xi$, or $|\delta Z + KZ| \geqq \xi$, then the DSP 750 is tasked with calculating a new orientation due to the ordnance 5 impacting some obstacle. The present invention accomplishes this by taking the next several motion profile samples as an initialization point, i.e., a new starting point for the position predictor function.

Once the alignment of the X 420, Y 410, and Z 430 sensors is determined, the incremental progress along each axis 401, 402, 403 can be calculated. It is important to note that the position movement up to this point does not change. As new positions are calculated, the progress is continuously updated. It is the update progress that determines where the ordnance is with respect to the reference coordinate system at any given point in time.

In terms of manner of making the ordnance device 5, as a matter of safe manufacturing, the fuse core along with batter and electronics may be loaded into the spherical structure before loading the ordnance. The ordnance device 5 may be scaled up to a large scale, for example 500 Kg to effect a significantly large kinetic energy for a given deployment or impact velocity.

Alternatively, the ordnance device 5 may be scaled down to a light weight orange or grape sized device, depending on mission requirements. To facilitate the smaller profile, such as a grape sized ordnance device 5, it is within the scope of the present invention to provide micro electro-mechanical systems (MEMS) accelerometers, gyros, and the like to be deployed as sensors 410, 420, and 430. Moreover, sensors 410, 420. 430 and processor 750, as well as associated electronic components may be integrated into a single application specific integrated circuit (ASIC). Additionally, it is within the scope of the present invention to provide additional load sensing devices capable of detecting counter gravitational forces on the ordnance device 5 to more accurately determine whether the ordnance device 5 is in free fall, or whether it is suspended in the air, or supported on the ground.

It is to be understood that the present invention is not limited to the embodiment described above, but encompasses any and all embodiments within the scope of the following claims.

I claim:

1. An explosive ordnance device, comprising:

a substantially spherical shaped structure having a hard outer shell, the combination of which is adaptable to rolling on a surface;

the spherical shaped structure further having a hollow inner core symmetrically disposed about an axial center of the structure;

a periphery of the hollow inner core having a shock absorbing layer;

the hollow inner core having within it a plurality of mutually orthogonal motion sensors rigidly attached to the core;

the plurality of mutually orthogonal motion sensors being electrically coupled to a computing device for accepting outputs of the sensors in order to compute motion profile samples;

the computing device being rigidly attached to the core;

an explosive charge being distributed between the shell and the core;

a fuse mechanism disposed within the explosive charge, and being electrically coupled to a primary arming device;

the primary arming device being armed responsive to predetermined criteria of the motion profile samples processed by the computing device;

wherein when the primary arming device is armed, the fuse is ignited to provide detonation of the ordnance device.

2. The explosive ordnance device according to claim 1, further comprising:

the outer shell having a coating to provide a customized coefficient of friction tailored to a mission type of bomb deployment.

3. The explosive ordnance device according to claim 1, further comprising:

the primary arming device being armed when the motion profile samples indicate that the ordnance device is motionless.

4. The explosive ordnance device according to claim 3, further comprising:

the primary arming device being armed only after a predetermined time has elapsed.

5. The explosive ordnance device according to claim 1, further comprising:

the primary arming device being armed when the motion profile samples indicate that the ordnance device has rolled to a stop.

6. The explosive ordnance device according to claim 5, further comprising:

the primary arming device having a fail-safe mechanism, wherein the primary arming device is armed only after a predetermined time has elapsed.

7. The explosive ordnance device according to claim 1, further comprising:

a motion trigger capable of arming the arming device; and, a computer trigger capable of arming the arming device.

8. The explosive ordnance device according to claim 7, further comprising:

a timer preloaded with a count, wherein the arming device is armed only after a predetermined time has elapsed.

9. The explosive ordnance device according to claim 7, further comprising:

one of the predetermined criteria of the motion profile samples being a predetermined location of the ordnance device that sets the computer trigger; and, a second of the predetermined criteria of the motion profile samples being a predetermined velocity of the ordnance device that sets the motion trigger.

10. The explosive ordnance device according to claim 9, further comprising:

a location estimator that utilizes the motion profile samples to determine an approximate location which can be compared to the predetermined location.

11. The explosive ordnance device according to claim 10, further comprising:

the location estimator having the capability to predict sensor orientation of the rolling ordnance device.

12. The explosive ordnance device according to claim 11, wherein the capability to predict sensor orientation further comprises the capability to estimate a current angular position and a next angular position of the rolling ordnance device.

13. The explosive ordnance device according to claim 12, wherein the capability to estimate the current angular position and the next angular position of the rolling ordnance device further comprises a linear approximation of the current angular position and the next angular position.

14. The explosive ordnance device according to claim 13, further comprising:

having the motion profile samples being expressed as, $X_n-X_{n-1}=\delta X$, $Y_n-Y_{n-1}=\delta Y$, and $Z_n-Z_{n-1}=\delta Z$.

15. The explosive ordnance device according to claim 14, further comprising:

having a moving average filter, wherein the motion profile samples are averaged over several periods to improve position estimates.

16. The explosive ordnance device according to claim 14, further comprising:

a computation of environmental influences, K, based on sensor measurements, wherein the location estimation is enhanced.

17. The explosive ordnance device according to claim 16, further comprising:

the location estimator providing a next predicted location expressed as $X_{n+1}=\delta X-X_n+KX$, $Y_{n+1}=\delta Y-Y_n+KY$, and $Z_{n+1}=Z-Z_n+KZ$.

18. The explosive ordnance device according to claim 17, further comprising:

a threshold impact determination function having a value $\xi$ so that when $|\delta X+KX|\geqq\xi$, or $|\delta Y+KY|\geqq\xi$, or $|\delta Z+KZ|\geqq\xi$, the computing device begins calculating a new orientation of the ordnance device due to impact with some obstacle.

19. The explosive ordnance device according to claim 18, wherein the location estimator further comprises an update progress that determines where the ordnance device is with respect to the reference coordinate system at any given point in time.

20. The explosive ordnance device according to claim 1, further comprising:

a system clock driving the computing device and having a minimum speed of approximately 33 MHZ to facilitate rapid acquisition and processing of the motion profile samples.

* * * * *